United States Patent [19]

DeClair et al.

[11] Patent Number: 5,012,599

[45] Date of Patent: May 7, 1991

[54] PROTECTIVE PAD ASSEMBLY FOR THE LOADER BUCKET OF A BACKHOE

[76] Inventors: Brian G. DeClair, 644 S. Orange Ave., El Cajon, Calif. 92020; Kevin C. Barkey, 3759 Tennyson St., San Diego, Calif. 92107

[21] Appl. No.: 526,024

[22] Filed: May 21, 1990

[51] Int. Cl.[5] ..... E02F 3/96

[52] U.S. Cl. ..... 37/117.5; 37/118 A; 37/141 R

[58] Field of Search ..... 37/117.5, 118 R, 118 A, 37/141 R, 270, 271

[56] References Cited

U.S. PATENT DOCUMENTS

| | | | |
|---|---|---|---|
| 634,578 | 10/1899 | Kaucher | 37/117.5 |
| 1,867,186 | 7/1932 | Soule et al. | 37/270 X |
| 4,242,035 | 12/1980 | Hornstein | 37/117.5 |
| 4,329,794 | 5/1982 | Rogers | 37/117.5 X |
| 4,819,349 | 4/1989 | Mensch | 37/117.5 |

*Primary Examiner*—Dennis L. Taylor

*Assistant Examiner*—Arlen L. Olsen

*Attorney, Agent, or Firm*—Charles C. Logan, II

[57] ABSTRACT

A protective pad assembly for the loader bucket of a backhoe that prevents the bottom surface of the loader bucket from marring or destroying any surface upon which it is forced downwardly upon when the backhoe is being used. The major component of the structure is an elongated rubber pad that has a top plate secured to its top surface. The front end of the top plate has a hook member extending rearwardly above its top surface for detachably capturing the lower front cutting edge of the loader bucket. A predetermined length of chain has one end connected to the top plate and its other end connected to a second hook member having a curved portion being configured to detachably receive the upper front edge of the loader bucket. There is also structure for temporarily shortening the extended length of the chain between the top plate and the second hook member thereby clamping the protective pad assembly to the loader bucket of a backhoe.

6 Claims, 2 Drawing Sheets

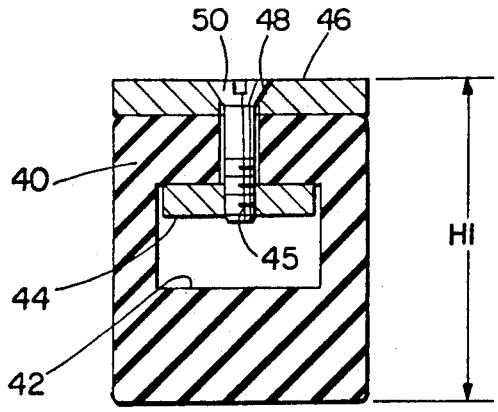
Fig. 4
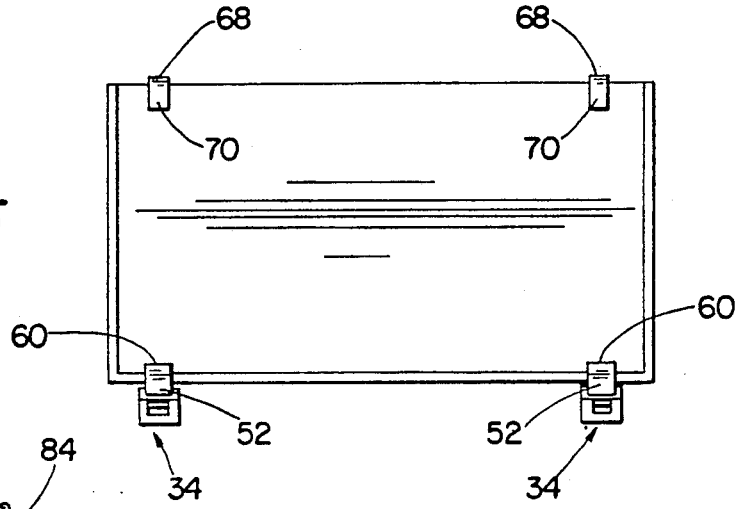
Fig. 5
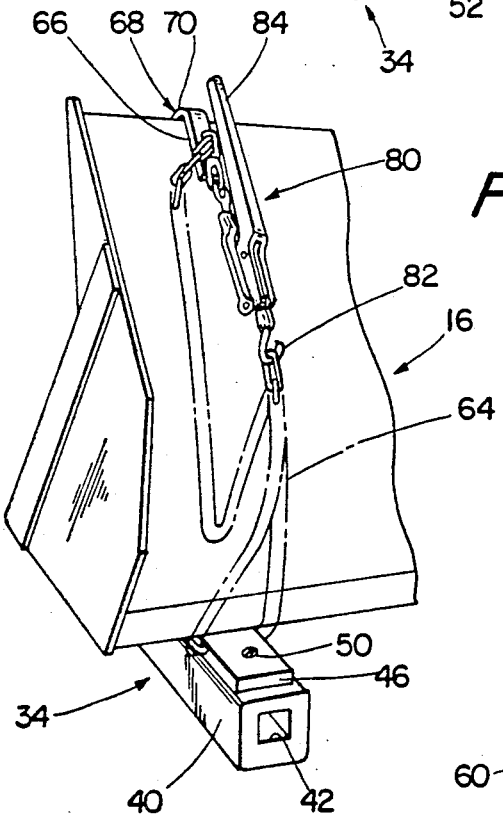
Fig. 6
Fig. 7
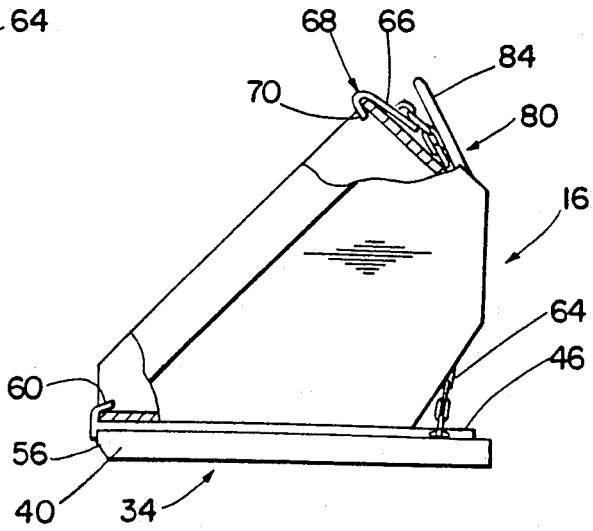

PROTECTIVE PAD ASSEMBLY FOR THE LOADER BUCKET OF A BACKHOE

BACKGROUND OF THE INVENTION

The invention relates to digging equipment such as backhoes. More specifically, it relates to a protective pad assembly for the loader bucket of a backhoe.

In a conventional stabilization practice for backhoe/-loaders, the bottom surface of the loader bucket is used to support the front end of the equipment as it is lifted from the ground by digging action by the backhoe at the other end. To achieve this position, the loader bucket is rolled over to orient the leading edge of the bucket in a downward position. When the leading bucket edge is in contact with concrete curbs or concrete or asphault street surfaces, the metal of the bucket on these surfaces will wear or break it up and leave damage.

It is an object of the invention to provide a novel protective pad assembly for the bottom surface of the loader bucket so it will not mar the support surface upon which it is resting when the backhoe is being utilized.

It is also an object of the invention to provide a novel protective assembly for the loader bucket of a backhoe that can be easily and quickly installed and removed.

It is another object of the invention to provide a novel protective pad assembly for the loader bucket of a backhoe that is economical to manufacture and market.

SUMMARY OF THE INVENTION

Applicant's novel protective pad assembly has been designed to be easily and quickly mounted and detached from the loader bucket of a backhoe. When mounted on the loader bucket, the metal edges of the loader bucket can not be positioned in contact with concrete or asphalt support surfaces and accordingly cannot damage it when the backhoe is being used.

The major component of the protective pad assembly is an elongated rubber pad. It has an elongated top plate mounted on its top surface. A hollow channel extends longitudinally through the entire length of the pad and it receives a lower bottom plate having threaded apertures therein. Bolts pass through bore holes in the top plate and then through aligned bore holes in the pad to be received in the threaded apertures of the bottom plate.

The length of the top plate is slightly shorter than the length of the elongated pad so that when the pad is moved rearwardly during its usage, there would not be a metal surface digging into curbs or other structure that the rear end of the pad may contact.

The front end of the top plate has a downwardly extending lip that covers a portion of the front end of the elongated pad and functions to prevent objects that are brought into contact with the front end of the pad from shearing the pad from the top plate.

The front end of the elongated pad has a beveled downwardly and rearwardly extending surface that allows the leading digging edge of the loader bucket to be angled at a steeper angle to dirt or other material it may be scooping up while the protective pad assembly is attached thereto.

A hook member is rigidly connected to the front end of the top plate member and it extends rearwardly over the top surface of the top plate so that the lower front cutting edge of the loader bucket of a backhoe can be detachably captured therein.

A second hook member has a shank portion and a curved portion that is configured to detachably receive the upper front edge of the loader bucket of the backhoe. A predetermined length of chain has its one end connected to the shank of the second hook member and its other end connected to the top plate member adjacent its rear end. The length of the chain is such that there is sufficient slack to install and remove the protective pad assembly from different sized buckets. A load or chain binder has its one end connected to the top plate member. The chain binder has a hook connected to it that is placed through one of the rings of the chain and actuation by the chain binder will shorten and tighten the length of chain between the second hook member and the rear end of the top plate member.

DESCRIPTION OF THE DRAWINGS

FIG. 4 is a cross sectional new taken along lines 4—4 of FIG. 1;

FIG. 5 is a front elevation view of a pair of assemblies mounted on the loader bucket;

FIG. 6 is a partial rear perspective view of the pad assembly mounted on the loader bucket; and FIG. 7 is a side elevation view of the pad assembly mounted on the loader bucket.

DESCRIPTION OF THE PREFERRED EMBODIMENT

Applicant's novel protective pad assembly for the loader bucket of a backhoe will now be described by referring to FIGS. 1–7 of the drawings.

Figure 1:
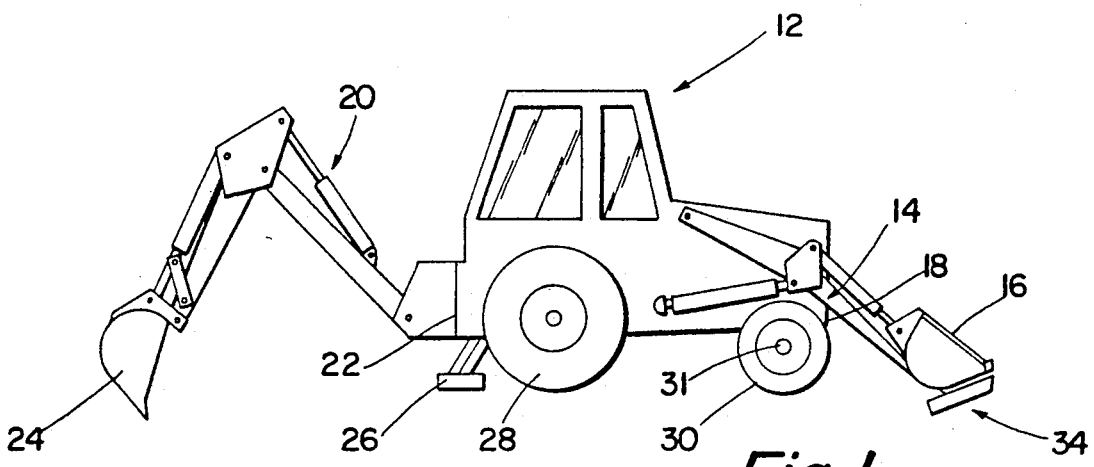
FIG. 1 is a side elevation view of a backhoe showing the protective pad assembly attached to the loader bucket.

FIG. 1 shows a conventional backhoe-loader tractor outfitted with applicant's novel protective pad assembly. The loader bucket arm unit consists of two loader bucket arms 14 and loader bucket 16. The unit is attached to the front end of tractor 12. Backhoe arm 20 is attached to the rear end 22 of the tractor to support digging bucket 24 therefrom. Two outriggers 26 extend from the side of the tractor near rear wheels 28 to provide lateral support. Two front wheels 30 are mounted on axle 31 located toward the forward end of the cab. The protective pad assembly 34 is detachably mounted on loader bucket 16.

Figure 2:
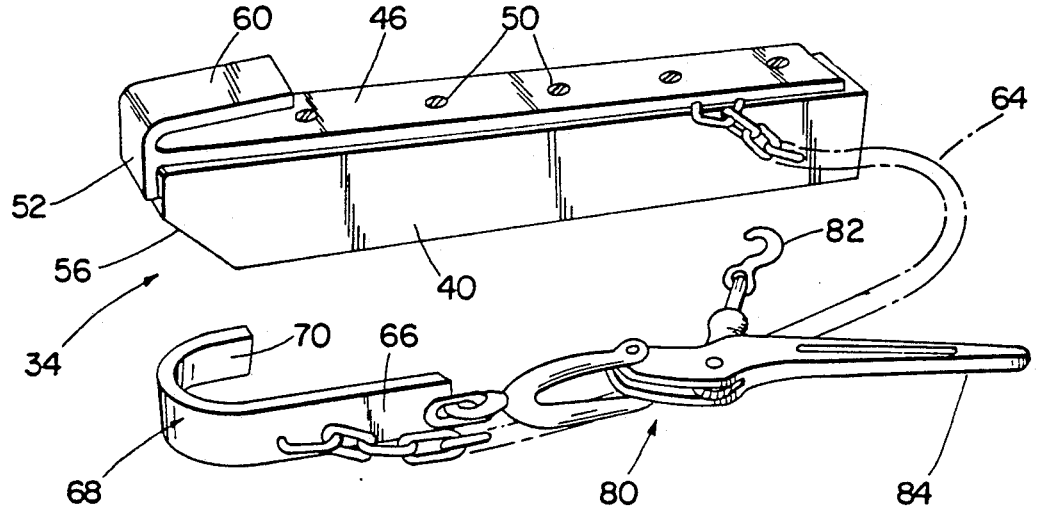
FIG. 2 is a front perspective view of the protective pad assembly prior to installation.
Figure 3:
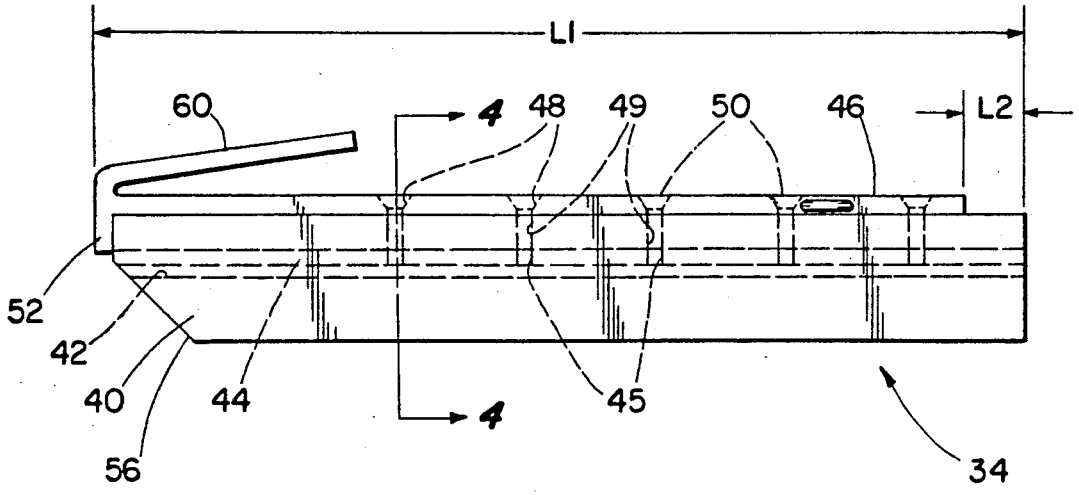
FIG. 3 is a side elevation view of the pad assembly.

In FIGS. 2 and 3, the specific structure of the protective pad assembly 34 is more clearly illustrated. An elongated pad 40, preferably made of rubber material, has a predetermined length L1. It has a substantially square cross sectional configuration and a channel 42 extends throughout its longitudinal length. A bottom plate 44 is received within channel 42 and it has a plurality of threaded apertures 45 at predetermined spaced intervals. A top plate 46 has a length L2 that extends from the front end of the pad 40 almost to its rear end. A plurality of spaced apertures 48 are formed in top plate 46 and they align with bore holes 49 in pad 40 and receive bolts 50 whose bottom ends are received in the threaded apertures 45 of the bottom plate 44. A lip 52 extends downwardly from the front end of top plate 46 in snug engagement with the front end of pad 40. Immediately below lip 50, pad 40 has a beveled front end portion 56. A hook member 60 extends upwardly and rearwardly from the front end of top plate 46 for receiving the front bottom edge of loader bucket 16.

A predetermined length of chain 64 has its one end rigidly secured to top plate 46 and its other end rigidly secured to the shank portion 66 of hook member 68. Hook member 68 has a curved portion 70 that is removably received on the top edge of loader bucket 16. A load or change binder 80 has its one end rigidly secured to top plate 46. It has a hook 82 and a locking handle 84. To attach the protective pad assembly to the loader bucket, hook members 60 and 68 are secured to the respective bottom and top edge of loader bucket 16. Next hook 82 is inserted into one of the loops of chain 64 and locking handle 84 is pivoted in a manner to tighten the chain binder 80 and secure the protective pad assembly in position.

What is claimed is:

1. A protective pad assembly for the loader bucket of a backhoe comprising:

an elongated pad of non-metallic material having a predetermined length L1 and predetermined height H1, said pad having a top surface, a bottom surface, a front end and a rear end;

an elongated top plate having a predetermined length L2, a front end, a rear end, a top surface and a bottom surface;

a first hook member rigidly connected to the front end of said top plate member and it extends rearwardly over the top surface of said top plate and it is spaced a predetermined height thereabove so that the lower front cutting edge of the loader bucket of a backhoe can be detachably captured therein;

means for securing said top plate to the top surface of said elongated pad;

a second hook member having a shank portion and a curved portion, said curved portion being configured to detachably receive the upper front edge of the loader bucket of a backhoe;

a predetermined extended length of chain having its one end connected to said top plate and its other end connected to the shank portion of said second hook member; and means for temporarily shortening the extended length of said chain between said top plate and said second hook member thereby clamping said protective pad assembly to the loader bucket of a backhoe.

2. A protective pad assembly as recited in claim 1 wherein a portion of the front end of said pad is beveled downwardly and rearwardly to its bottom surface.

3. A protective pad assembly as recited in claim 1 wherein L2 is less than L1 so that the rear end of said top plate does not extend all the way to the rear end of said elongated pad.

4. A protective pad assembly as recited in claim 1 wherein said top plate has a downwardly extending lip that contacts the front end of said elongated pad.

5. A protective pad assembly as recited in claim 1 wherein said elongated pad is made of rubber material.

6. A protective pad assembly as recited in claim 1 wherein said elongated pad has a substantially square cross section.

* * * * *